US009910390B2

(12) United States Patent
Okamoto et al.

(10) Patent No.: US 9,910,390 B2
(45) Date of Patent: Mar. 6, 2018

(54) IMAGE FORMING APPARATUS

(71) Applicant: Konica Minolta, Inc., Chiyoda-ku, Tokyo (JP)

(72) Inventors: Akira Okamoto, Hino (JP); Keigo Ogura, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/359,681

(22) Filed: Nov. 23, 2016

(65) Prior Publication Data

US 2017/0168433 A1 Jun. 15, 2017

(30) Foreign Application Priority Data

Dec. 11, 2015 (JP) ..... 2015-241736

(51) Int. Cl.
*G03G 15/20* (2006.01)

(52) U.S. Cl.
CPC ..... *G03G 15/2039* (2013.01); *G03G 15/2007* (2013.01)

(58) Field of Classification Search
CPC ..... G03G 15/2007; G03G 15/2039; G03G 15/2015
See application file for complete search history.

(56) References Cited

U.S. PATENT DOCUMENTS

2009/0052927 A1* 2/2009 Yoshikawa ..... G03G 15/2039 399/69
2010/0322656 A1* 12/2010 Chosokabe ..... G03G 15/80 399/67
2011/0064444 A1* 3/2011 Adachi ..... G03G 15/80 399/69

(Continued)

FOREIGN PATENT DOCUMENTS

JP 2002-162852 A 6/2002
JP 2011257604 A 12/2011

(Continued)

OTHER PUBLICATIONS

Office Action (Notification of Reasons for Refusal) dated Jan. 9, 2018 by the Japanese Patent Office in corresponding Japanese Patent Application No. 2015-241736 and English Translation of the Office Acton. (12 pages).

*Primary Examiner* — Clayton E Laballe
*Assistant Examiner* — Ruifeng Pu
(74) *Attorney, Agent, or Firm* — Buchanan Ingersoll & Rooney PC

(57) ABSTRACT

An image forming apparatus includes a processor and heaters which heat a fixing member of an image fixing device. The processor calculates an application pattern for the heaters based on a temperature of the fixing member and generates a drive voltage by suitably selecting half waves from an AC waveform of an AC power supply according to the application pattern. When a duration of time the drive (Continued)

voltage is applied to a first heater in the application pattern having a duty cycle of a predetermined level or less exceeds a predetermined period of time, (i) the processor turns off the first heater and turns on a second heater with a different distribution, or (ii) the processor increases the duty cycle of the first heater and decreases a duty cycle of the second heater.

6 Claims, 7 Drawing Sheets

(56) References Cited

U.S. PATENT DOCUMENTS

| | | | | |
|---|---|---|---|---|
| 2011/0303648 | A1* | 12/2011 | Kasai | G03G 15/2007 219/216 |
| 2012/0051774 | A1 | 3/2012 | Ikebuchi et al. | |
| 2015/0286175 | A1 | 10/2015 | Okamoto et al. | |
| 2016/0266526 | A1* | 9/2016 | Hayashi | G03G 15/5004 |
| 2017/0082959 | A1* | 3/2017 | Sasaki | G03G 15/2039 |
| 2017/0097596 | A1* | 4/2017 | Noutomi | G03G 15/2039 |
| 2017/0219970 | A1* | 8/2017 | Tamaki | G03G 15/2007 |

FOREIGN PATENT DOCUMENTS

| | | | |
|---|---|---|---|
| JP | 2012-53148 | A | 3/2012 |
| JP | 2015-197670 | A | 11/2015 |

* cited by examiner

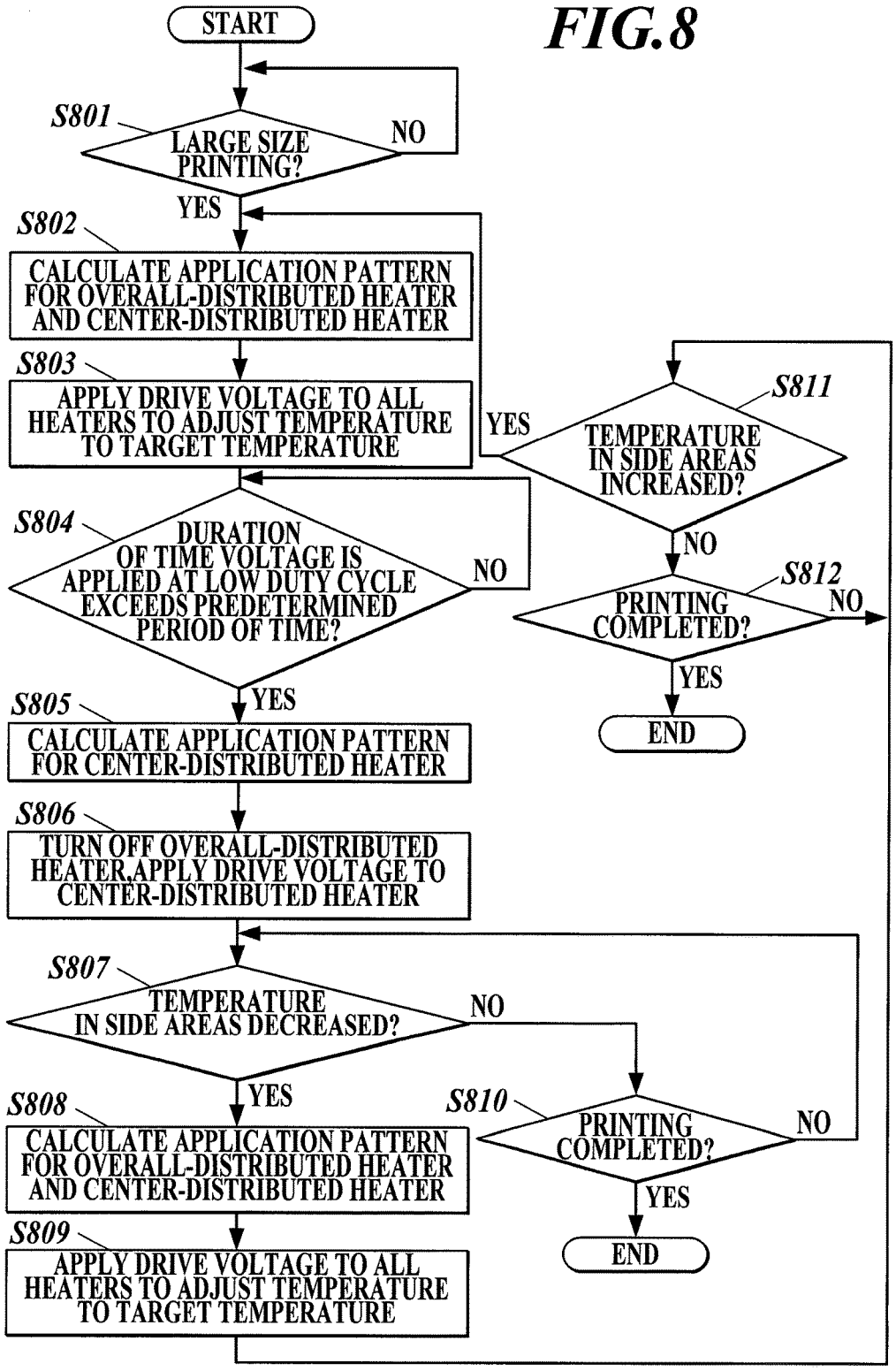
FIG.8
START
S801
LARGE SIZE PRINTING?
NO
YES
S802
CALCULATE APPLICATION PATTERN FOR OVERALL-DISTRIBUTED HEATER AND CENTER-DISTRIBUTED HEATER
S803
APPLY DRIVE VOLTAGE TO ALL HEATERS TO ADJUST TEMPERATURE TO TARGET TEMPERATURE
S804
DURATION OF TIME VOLTAGE IS APPLIED AT LOW DUTY CYCLE EXCEEDS PREDETERMINED PERIOD OF TIME?
NO
YES
S805
CALCULATE APPLICATION PATTERN FOR CENTER-DISTRIBUTED HEATER
S806
TURN OFF OVERALL-DISTRIBUTED HEATER,APPLY DRIVE VOLTAGE TO CENTER-DISTRIBUTED HEATER
S807
TEMPERATURE IN SIDE AREAS DECREASED?
NO
YES
S808
CALCULATE APPLICATION PATTERN FOR OVERALL-DISTRIBUTED HEATER AND CENTER-DISTRIBUTED HEATER
S809
APPLY DRIVE VOLTAGE TO ALL HEATERS TO ADJUST TEMPERATURE TO TARGET TEMPERATURE
S810
PRINTING COMPLETED?
NO
YES
END
S811
TEMPERATURE IN SIDE AREAS INCREASED?
YES
NO
S812
PRINTING COMPLETED?
NO
YES
END

IMAGE FORMING APPARATUS

BACKGROUND OF THE INVENTION

1. Field of the Invention

The present invention relates to an image forming apparatus.

2. Description of Related Art

To control the fixing process in an image forming apparatus, a halogen lamp heater has been used as a fixing heater, and the temperature of the fixing heater has been operated by on-off control thereof. To achieve finer temperature control, a control method has been known in the art which involves generating a drive voltage by suitably selecting half waves from an AC (alternating current) waveform and applying it to a halogen lamp heater.

In such control methods, the number of half waves selected from an AC waveform in a predetermined cycle (duty cycle) is suitably selected according to the amount of heat required, and the effective drive voltage applied to the halogen lamp heater varies depending on the number of half waves selected from the AC waveform.

A halogen lamp heater has a specific standard voltage at which so-called halogen cycle becomes the most effective. When the number of half waves selected from an AC waveform is so small that the applied effective drive voltage is lower than the standard voltage, a phenomenon of filament erosion (also known as chemical attack) occurs due to the decreased temperature of the filament (tungsten) of the halogen lamp heater.

To cope with the problem, a heater controller that has been known in the art is configured such that all halogen lamp heaters are operated (turned on) at the maximum output in every predetermined period even in a stand-by mode so that the halogen cycle circulates, and then after the filaments are heated to a predetermined temperature, the halogen lamp heaters are not turned off but a drive voltage is generated by suitably selecting half waves from an AC waveform and is applied to halogen lamp heaters. The heater controller thus prevents a break of the filaments and also reduces flickers (JP 2011-257604A).

However, the amount of heat required for forming an image varies depending on the type and size of sheet that is used as a recording medium. For example, when an image is formed on a small sheet, the amount of heat required is small, and the voltage is applied in such a pattern that is composed of a small number of half waves selected from an AC waveform in a predetermined cycle (low duty cycle). Therefore, a problem with the prior art is that when a drive voltage is applied continuously in such an application pattern having a low duty cycle for a long time, the life of a halogen lamp heater is decreased due to an occurrence of chemical attack.

SUMMARY OF THE INVENTION

It is an object of the present invention to provide an image forming apparatus that can extend the life of halogen lamp heaters.

In order to realize the above object, according to a first aspect of the present invention, there is provided an image forming apparatus, including:

halogen lamp heaters with different distributions which heat a fixing member of an image fixing device;

an AC power supply;

a temperature detector which detects a temperature of the fixing member; and a processor which calculates an application pattern for the halogen lamp heaters based on an output of the temperature detector and which generates a drive voltage by suitably selecting half waves from an AC waveform of the AC power supply according to the application pattern and applies the drive voltage to the halogen lamp heaters, wherein when a duration of time the drive voltage is applied to a first halogen lamp heater in the application pattern having a duty cycle of a predetermined level or less exceeds a predetermined period of time, (i) the processor turns off the first halogen lamp heater and turns on a second halogen lamp heater with a different distribution, or (ii) the processor increases the duty cycle of the first halogen lamp heater to greater than the predetermined level and decreases a duty cycle of the second halogen lamp heater.

Preferably, when a duration of time the drive voltage is applied to the first halogen lamp heater in the application pattern having a duty cycle of a predetermined level or less exceeds a predetermined period of time, the processor applies the drive voltage to the first and second halogen lamp heaters in the application pattern having a duty cycle of greater than the predetermined level.

Preferably, the halogen lamp heaters includes an overall-distributed halogen lamp heater which heats an entire area of the fixing member and a center-distributed halogen lamp heater which heats a center area of the fixing member, and when a width of a recording medium is less than a width of the center-distributed halogen lamp heater, the processor applies the drive voltage to the center-distributed halogen lamp heater in a first application pattern having a duty cycle of a predetermined level or less, and (i) when the duration of time exceeds a predetermined period of time, the processor applies the drive voltage to the overall-distributed halogen lamp heater in a second application pattern having a duty cycle of greater than the predetermined level, and (ii) when a temperature in a non-sheet area of the fixing member is increased to a predetermined threshold or more, the processor applies the drive voltage to the center-distributed halogen lamp heater in the first application pattern.

Preferably, when the temperature in the non-sheet area is equal to or greater than the threshold and the duration of time the drive voltage is applied in the first application pattern exceeds a predetermined period of time in the center-distributed halogen lamp heater, the processor suspends image formation and rotates the fixing member.

Preferably, the halogen lamp heaters includes an overall-distributed halogen lamp heater which heats an entire area of the fixing member, a center-distributed halogen lamp heater which heats a center area of the fixing member and a side-distributed halogen lamp heater which heats side areas of the fixing member, and when a width of a recording medium is greater than a width of the center-distributed halogen lamp heater but is equal to or less than a width of the overall-distributed halogen lamp heater, the processor operates the side-distributed halogen lamp heater by an on-off control, operates the overall-distributed halogen lamp heater at a maximum output and applies the drive voltage to the center-distributed halogen lamp heater in a first application pattern having a duty cycle of a predetermined level or less, and (i) when a duration of time the drive voltage is applied exceeds a predetermined period of time in the center-distributed halogen lamp heater, the processor turns off the overall-distributed halogen lamp heater and applies the drive voltage to the center-distributed halogen lamp heater in a second application pattern having a duty cycle of greater than the predetermined level, and (ii) when a temperature in the side areas of the fixing member decreases to a predetermined threshold or less, the processor applies the drive voltage to the overall-distributed halogen lamp heater and the center-distributed halogen lamp heater in a third application pattern having a duty cycle of greater than the predetermined level.

Preferably, when the temperature in the side areas is equal to or less than the threshold and the temperature in the side areas is not increased, the processor operates the overall-distributed halogen lamp heater at the maximum output and applies the drive voltage to the center-distributed halogen lamp heater in the first application pattern.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein:

FIG. 8 is a flowchart illustrating another example of the operation of the image forming apparatus.

DETAILED DESCRIPTION OF THE PREFERRED EMBODIMENT

Embodiment

1. Description of Configuration

Hereinafter, an image forming apparatus according to an embodiment of the present invention will be described based on the drawings.

Figure 1:
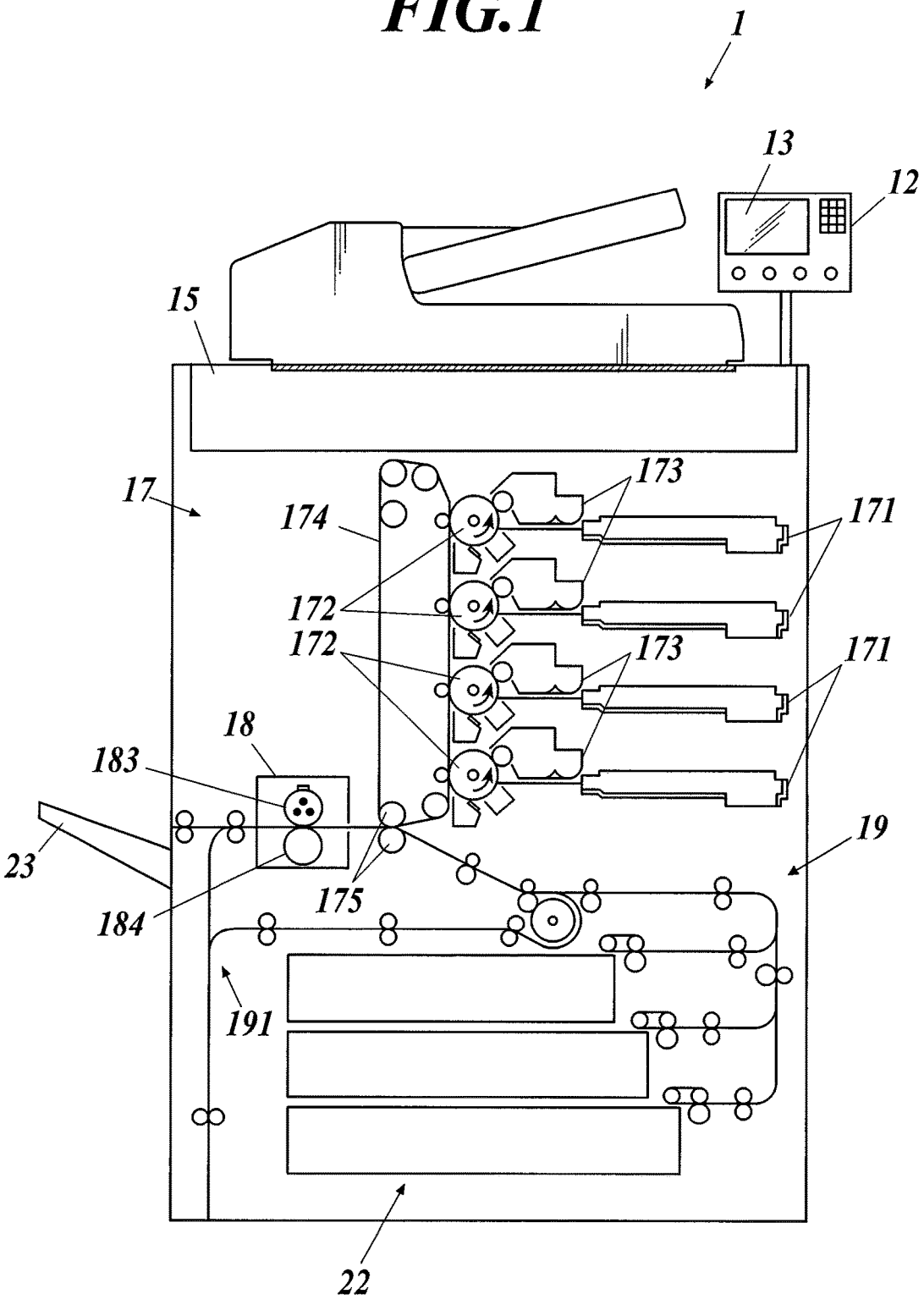
FIG. 1 illustrates the schematic configuration of an image forming apparatus according to an embodiment of the present invention.
Figure 2:
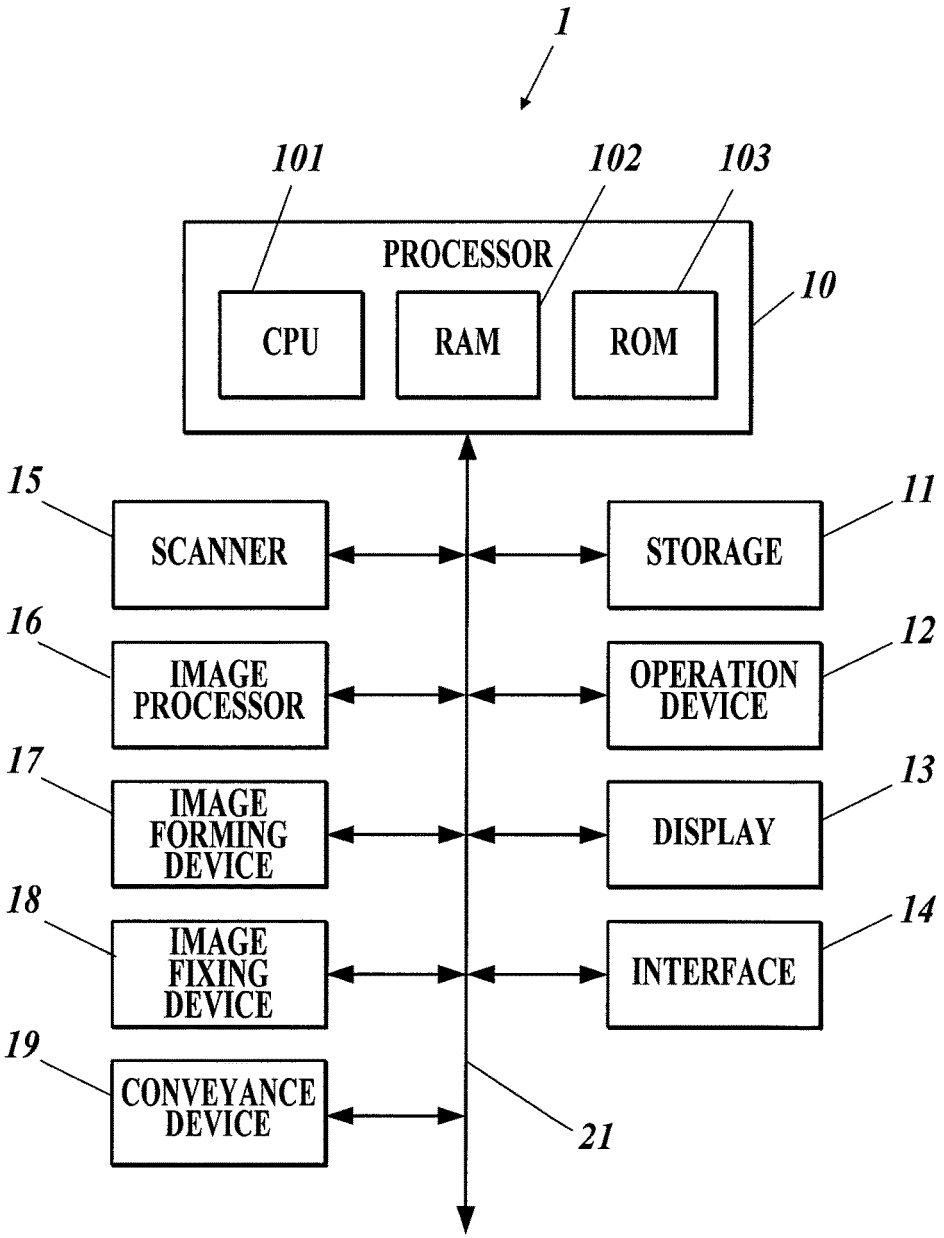
FIG. 2 is a block diagram of the main functional configuration of the image forming apparatus.

FIG. 1 is the schematic configuration of the image forming apparatus 1 according to the embodiment of the present invention. FIG. 2 is a block diagram of the main functional configuration of the image forming apparatus 1.

The image forming apparatus 1 includes a processor 10 that includes a CPU 101 (central processing unit), a RAM 102 (random access memory) and a ROM 103 (read only memory), a storage 11, an operation device 12, a display 13, an interface 14, a scanner 15, an image processor 16, an image forming device 17, an image fixing device 18, a conveyance device 19 and the like. The processor 10 is connected to the storage 11, the operation device 12, the display 13, the interface 14, the scanner 15, the image processor 16, the image forming device 17, the image fixing device 18 and the conveyance device 19 via a bus 21.

The CPU 101 reads out a control program stored in the ROM 103 or the storage 11 and executes it to perform a variety of processing.

The RAM 102 provides a working memory space to the CPU 101 and stores temporary data.

The ROM 103 stores a variety of control programs to be executed by the CPU 101, setting data and the like. In replace of the ROM 103, a rewritable non-volatile memory such as an EEPROM (electrically erasable programmable read only memory) or a flash memory may be used.

The processor 10 that includes the above-described CPU 101, RAM 102 and ROM 103 integrally controls the components of the image forming apparatus 1 according to the above-described control programs. For example, the processor 10 controls the image processor 16 to perform predetermined image processing on image data, and then stores it in the storage 11. Further, the processor 10 controls the conveyance device 19 to convey a sheet and also controls the image forming device 17 to form an image based on the image data stored in the storage 11.

The storage 11 is composed of a storing means such as a DRAM (dynamic random access memory), which is a semiconductor memory, and an HDD (hard disk drive). In the storage 11, image data obtained by the scanner 15, image data input from the outside via the interface 14 and the like are stored. Such image data and the like may be stored in the RAM 102 instead.

The operation device 12, which includes input devices such as operation keys and a touch panel overlaid on a screen of the display 13, converts an operation input on the input devices to an operation signal and outputs it to the processor 10.

The display 13, which includes a display device such as an LCD (liquid crystal display), displays the status of the image forming apparatus 1, an operation screen that shows operations to be input on the touch panel and the like.

The interface 14 is configured to send and receive data to and from an external computer, another image forming apparatus and the like, which is constituted by, for example, a serial interface of any type.

The scanner 15 reads an image formed on a sheet and generates image data including individual monochromatic image data with respect to each of the color components of R (red), G (green) and B (blue) and stores it in the storage 11.

The image processor 16, which includes, for example, a rasterizing processor, a color converter, a gradation corrector and a halftone processor, performs a variety of image processing on image data stored in the storage 11 and stores it in the storage 11, The image forming device 17 forms an image on a sheet based on image data stored in the storage 11. The image forming device 17 includes four sets of an exposing unit 171, a photoreceptor 172 and a developing unit 173 respectively for the color components of C (cyan), M (magenta), Y (yellow) and K (black). The image forming device 17 further includes a transfer body 174 and a secondary transfer roller 175.

The exposing unit 171 includes an LD (laser diode) as a light emitting element. The exposing unit 171 drives the LD based on image data to irradiate the charged photoreceptors 172 with laser light to expose them, so as to form an electrostatic latent image on the photoreceptors 172. The developing units 173 supply toner (coloring material, any color of C, M, Y and K) onto the exposed photoreceptors 172 by means of charged developing rollers so as to develop the electrostatic latent images formed on the photoreceptors 172.

The images (monochromatic images) on the four photoreceptors 172 of C, M, Y and K formed by the respective toners of C, M, Y and K are transferred from the photoreceptors 172 and sequentially overlaid on the transfer body 174. In this way, a color image that is composed of the color components of C, M, Y and K is formed on the transfer body 174. The transfer body 174, which is constituted by an endless belt supported by transfer body conveyance rollers, is driven according to the rotation of the transfer body conveyance rollers.

The secondary transfer roller 175 transfers the color image on the transfer body 174 onto a sheet that is fed from a sheet feeding tray 22 or an external sheet feeding device. In more detail, a predetermined transfer voltage is applied to the sheet and the secondary transfer roller 175 that nips the transfer body 174, and the toner of the color image on the transfer body 174 is thereby drawn toward the sheet and thus transferred to the sheet.

The image fixing device 18 performs fixation that involves heating and pressing the sheet on which the toner has been transferred so as to fix the toner on the sheet.

Figure 3:
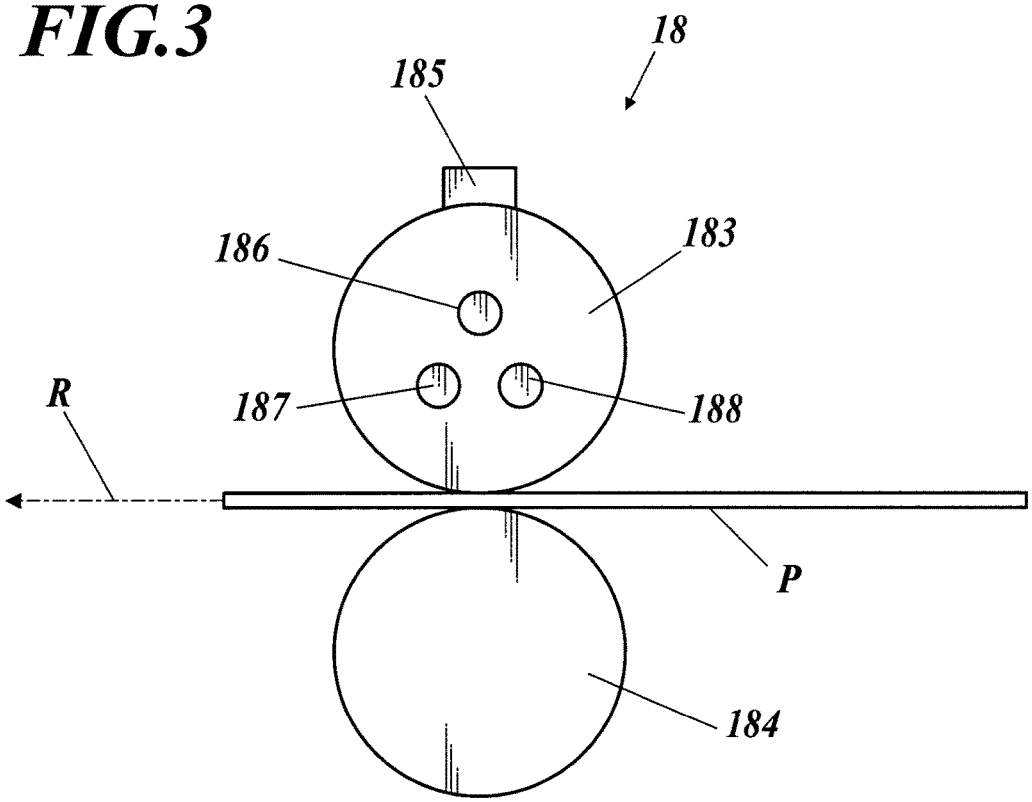
FIG. 3 is a schematic view of an image fixing device.

FIG. 3 is a schematic view of the configuration of the image fixing device 18. The image fixing device 18 includes a fixing roller 183, a pressing roller 184, a temperature detector 185 and the like. The image fixing device 18 and the processor 10 constitute a fixing apparatus.

The fixing roller 183 includes halogen lamp heaters 186 to 188 each of which is constituted by a fixing lamp (or a fixing heater) extending along the rotating axis. The halogen lamp heaters 186 to 188 generate heat by being energized under control of the processor 10. The fixing roller 183 is rotated by a rotating means (not shown) such as a motor under control of the processor 10. In the fixing roller 183, a temperature detector 185 is provided to detect the temperature of the fixing roller 183. The temperature detector 185 may be composed of either single temperature detector or two or more temperature detectors as long as it can detect the temperature of the fixing roller 183.

Figure 4:
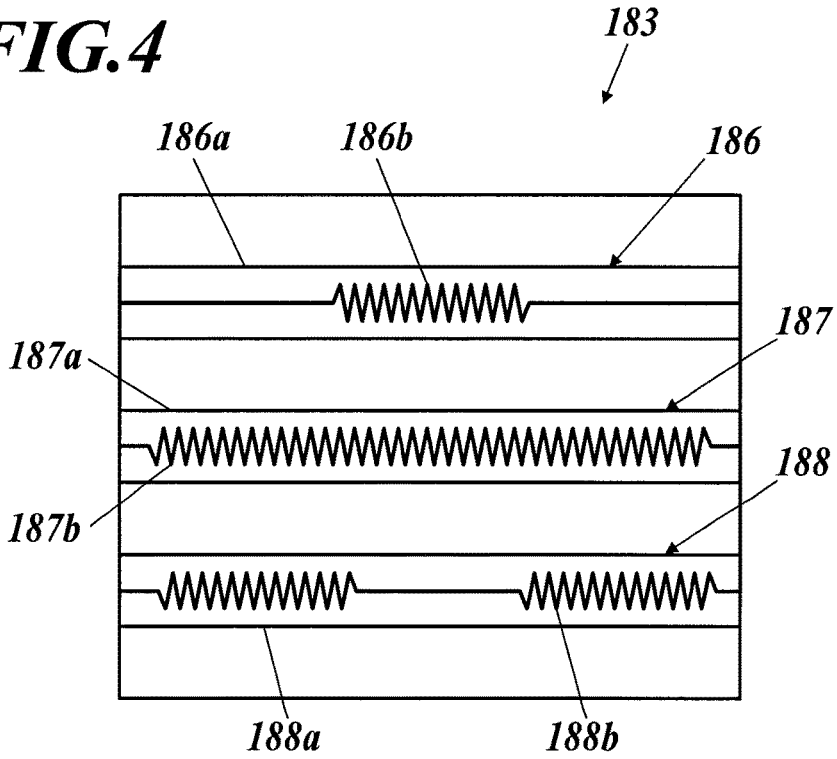
FIG. 4 is a schematic view of the internal configuration of a fixing roller.

FIG. 4 is a schematic view of the internal configuration of the fixing roller 183.

The halogen lamp heaters 186 to 188 respectively include tungsten filaments 186*b* to 188*b* that are disposed in cylinders 186*a* to 188*a* filled with halogen gas at a predetermined concentration. The standard voltage of the halogen lamp heaters 186 to 188 is specified according to the concentration of the halogen gas in the respective cylinders 186*a* to 188*a*.

The filament 186*b* of the halogen lamp heater 186 is configured to heat only the center part in the axis direction of the fixing roller 183 (center distribution). The filament 187*b* of the halogen lamp heater 187 is configured to heat all part in the axis direction of the fixing roller 183 (overall distribution). The filament 188*b* of the halogen lamp heater 188 is configured to heat only the side parts in the axis direction of the fixing roller 183 (side distribution).

As illustrated in FIG. 3, the pressing roller 184 is biased toward the fixing roller 183 by means of an elastic member (not shown) and is thereby in pressure contact with the fixing roller 183. The pressing roller 184 is rotated along with the rotation of the fixing roller 183, in which a fixing nip is formed between the fixing roller 183 and the pressing roller 184.

The pressing roller 184 may be rotated by a rotating means (not shown) such as a motor under control of the processor 10.

The fixing roller 183 and the pressing roller 184 nip a sheet P of a recording medium at the fixing nip and heat and press the sheet P while conveying it in the conveyance direction R as illustrated by the arrow in FIG. 3. The fixing roller 183 and the pressing roller 184 thus melt the toner on the sheet P and thereby fix it. When in contact with the sheet P, the temperature of the fixing roller 183 is controlled within the range of 180° C. to 200° C. Accordingly, the halogen lamp heaters 186 to 188 heat the fixing roller 183 so that the temperature of the fixing roller 183 falls within the range.

As illustrated in FIG. 1, the conveyance device 19, which includes sheet conveyance rollers that nip and convey a sheet by rotation, conveys the sheet in a predetermined conveyance route. The conveyance device 19 includes a flipping mechanism 191 that flips the sheet on which the image fixing device 18 has performed the fixation and conveys it to the secondary transfer roller 175. In the image forming apparatus 1, when images are formed on both sides of a sheet, the flipping mechanism 191 flips over the sheet and the images are formed on the both sides, and the sheet is then ejected to a sheet tray 23. When an image is formed only on one side of a sheet, the sheet on which the image has been formed on one side is ejected to the sheet tray 23 without being flipped by the flipping mechanism 191.

2. Description of Control Circuit of Image Fixing Device

Figure 5:
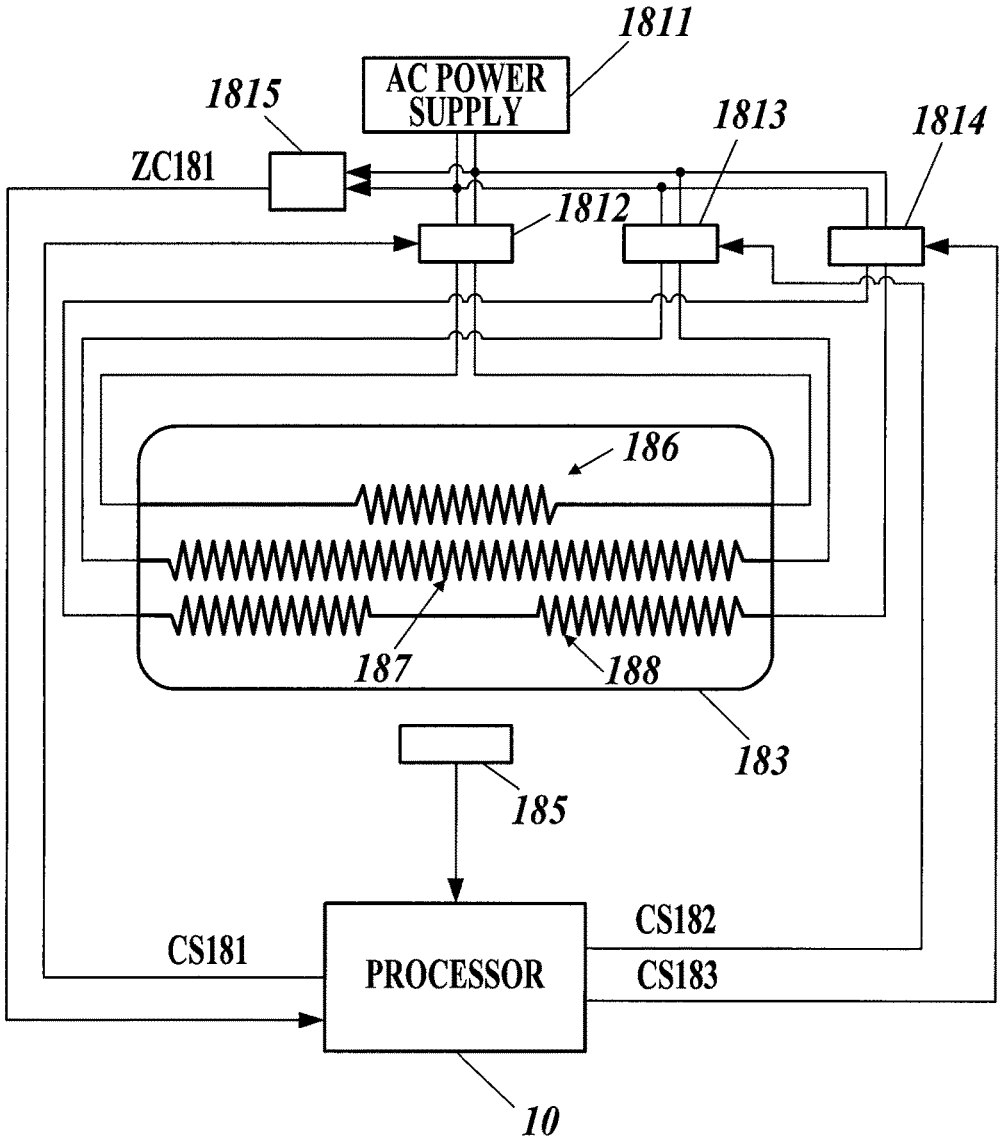
FIG. 5 is a control circuit diagram of the image fixing device.

In FIG. 5, an AC power supply 1811 outputs typical AC power (e.g. 100 V or 200V, 50 Hz or 60 Hz).

A switching element 1812, a switching element 1813 and a switching element 1814 are each constituted by a thyristor, a bidirectional thyristor (triac) or the like which turns to the "ON" state to be electrically conductive when a trigger signal is applied to the gate that serves as a control terminal. The output terminal of the AC power supply 1811 is connected to the input terminals of the switching element 1812, the switching element 1813 and the switching element 1814. The output terminals of the switching element 1812, the switching element 1813 and the switching element 1814 are connected respectively to the input terminals of the halogen lamp heaters 186 to 188.

The processor 10 controls the temperature of the halogen lamp heaters 186 to 188. Specifically, the processor 10 together with the switching element 1812, the switching element 1813 and the switching element 1814 function as a power controller. The processor 10 controls the switching element 1812, the switching element 1813 and the switching element 1814 with control signals (CS181, CS182 and CS183) to generate a drive voltage that is composed of half waves selected from the AC waveform output from the AC power supply 1811, and supplies it to halogen lamp heaters 186 to 188.

The temperature detector 185, which is constituted by a temperature detecting element such as a temperature sensor, is provided in the vicinity of the fixing roller 183 to detect the temperature of the fixing roller 183 and to output it to the processor 10.

A zero-cross detector 1815 receives the output of the AC power supply 1811, generates a zero-cross signal ZC181 and outputs it to the processor 10.

3. Description of Selecting Half Waves of Ac Waveform

A method of generating the a drive voltage by selecting half waves from the AC waveform output from the AC power supply 1811 by means of the switching element 1812, the switching element 1813 and the switching element 1814 and supplying them to the halogen lamp heaters 186 to 188 will be described with FIG. 6.

The zero-cross detector 1815 detects a point where the AC waveform output from the AC power supply 1811 crosses ±0 V. The zero-cross detector 1815 generates the zero-cross signal ZC 181 with an output value that alternates at the timing of the detection as illustrated by (b) in FIG. 6, and outputs it to the processor 10.

Figure 6:
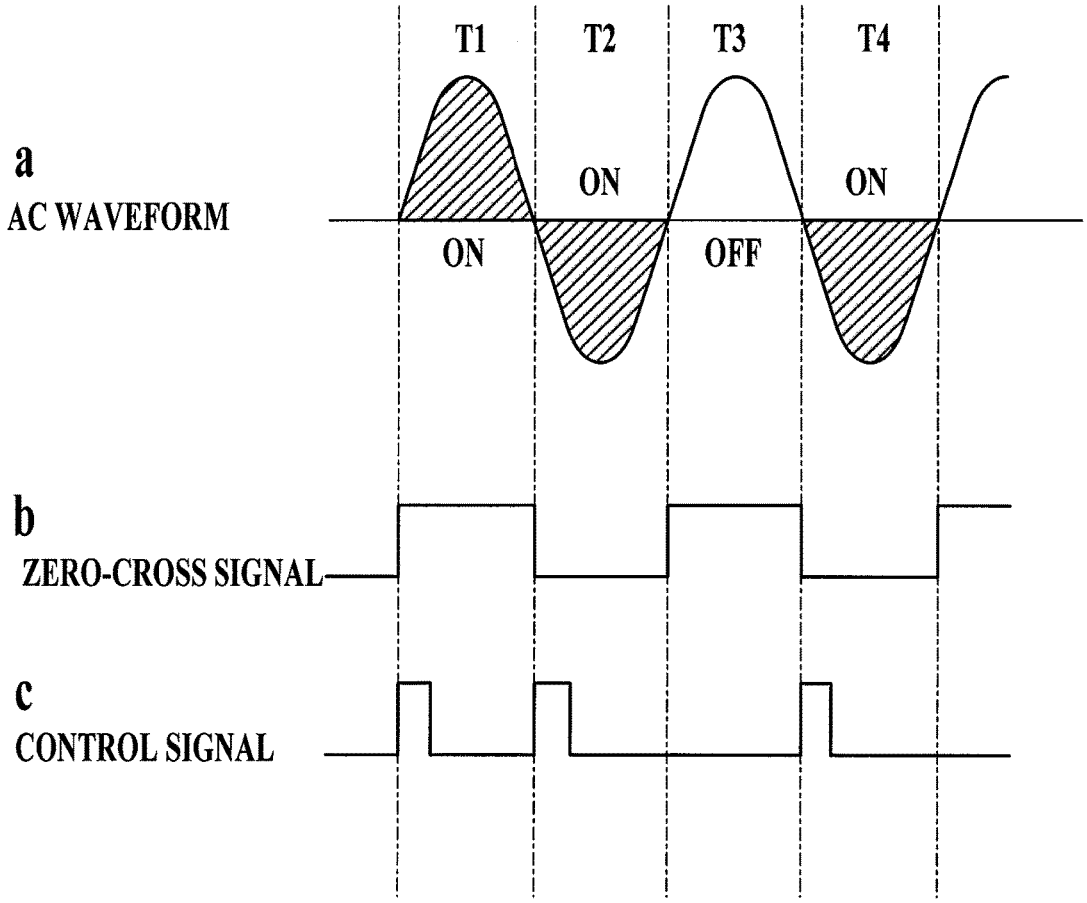
FIG. 6 is an explanatory view of an example of selection of half waves of an AC waveform.

The processor 10 generates a control signal CS181 (control signal CS182, control signal CS183) that is synchronized with the input zero-cross signal ZC181 as illustrated by (c) in FIG. 6, and applies it to the control terminal of the switching element 1812 (switching element 1813, switching element 1814).

That is, as illustrated in FIG. 6, in the period T1, period T2 and period T4 in which the control signal CS181 (control signal CS182, control signal CS183) is applied from the processor 10, the switching element 1812 (switching element 1813, switching element 1814) is turned to the "ON" state to be electrically conductive, and a half wave is therefore selected from the AC waveform output from the AC power supply 1811 and supplied to the halogen lamp heater 186 (halogen lamp heater 187, halogen lamp heater 188).

In the period T3 in which the control signal CS181 (control signal CS182, control signal CS183) is not applied from the processor 10, the switching element 1812 (switching element 1813, switching element 1814) remains in the "OFF" state to be electrically non-conductive, and no half wave is therefore selected from the AC waveform output from the AC power supply 1811.

The switching element 1812 (switching element 1813, switching element 1814) remains to be electrically conductive once a trigger signal (control signal) is applied to the gate, but it returns to be electrically non-conductive when the voltage becomes 0 V as in the AC waveform. Accordingly, even when it is turned to be electrically conductive in the period T2, it automatically returns to be electrically non-conductive in the period T3.

4. Description of Operation of Image Forming Apparatus

The operation of the image forming apparatus 1 will be described with the flowcharts of FIG. 7 and FIG. 8.

Regarding the size of the sheet P, for example, a sheet P that is wider than the filament 186*b* of the center-distributed halogen lamp heater 186 but is equal to or narrower than the filament 187*b* of the overall-distributed halogen lamp heater 187 is referred to a sheet of a "large size", and a sheet P that is narrower than the filament 186*b* of the center-distributed halogen lamp heater 186 is referred to as a sheet of a "small size".

4.1. Description of Operation in Printing on Small Size Sheet

Figure 7:
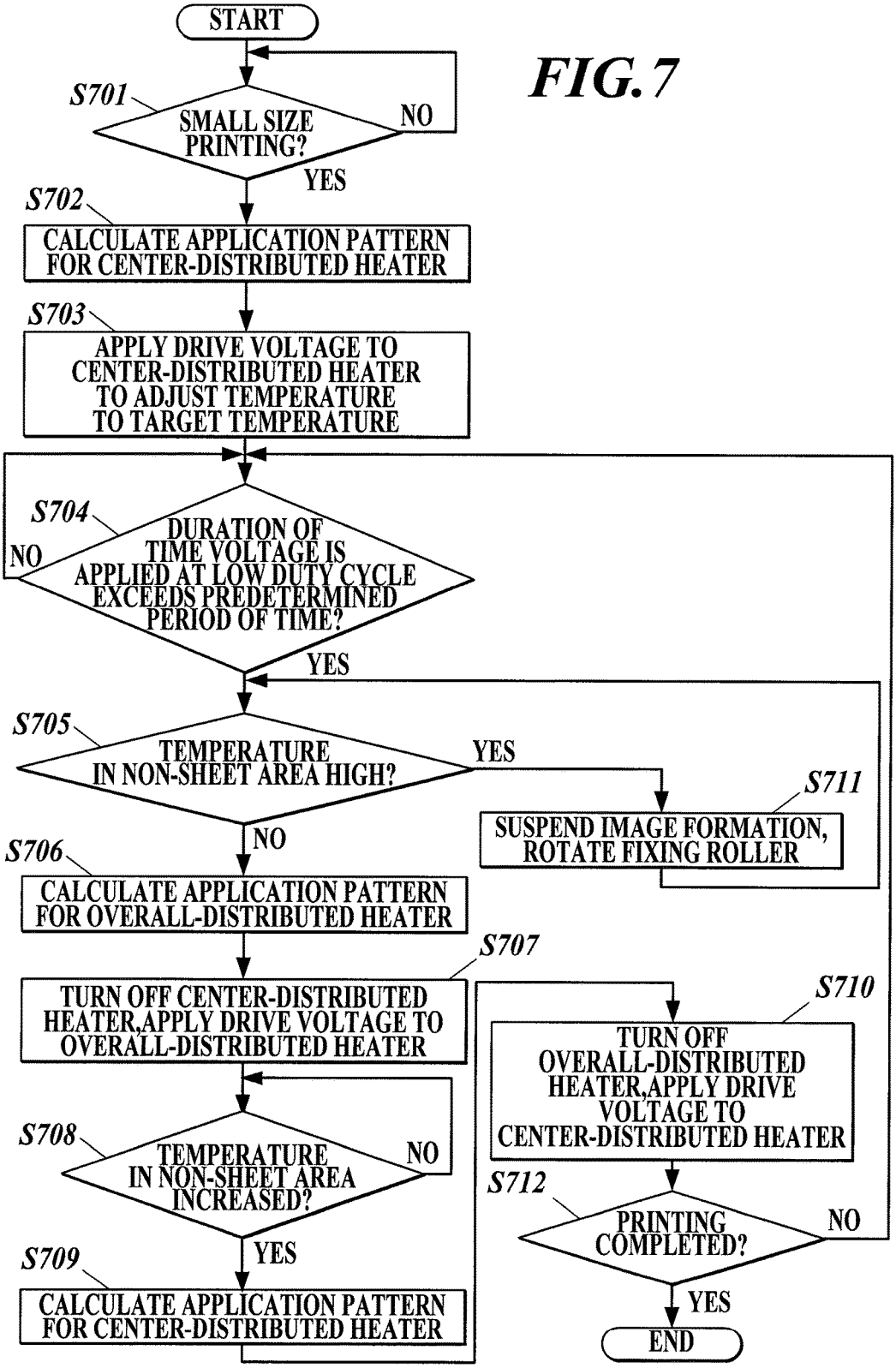
FIG. 7 is a flowchart illustrating an example of the operation of the image forming apparatus.

The flowchart of FIG. 7 assumes a case in which the sheet P is a thin sheet of the "small size" that requires a small amount of heat. The overall-distributed halogen lamp heater 187 has a maximum output of 700 W and a filament length of 320 mm, and the center-distributed halogen lamp heater 186 has a maximum output of 900 W and a filament length of 210 mm.

The processor 10 makes a determination as to whether the sheet P on which printing (image formation) is to be performed is of the "small size" (Step S701). That is, the processor 10 makes a determination as to whether the width in the direction perpendicular to the sheet conveyance direction of the sheet P is less than the length of the filament 186*b* of the center-distributed halogen lamp heater 186.

When it is determined that the sheet P on which printing (image formation) is to be performed is of the "small size" (Step S701, Yes), the processor 10 calculates an application pattern for the center-distributed halogen lamp heater 186 based on the output of the temperature detector 185 (Step S702) since the sheet P can be sufficiently heated by means of the center-distributed halogen lamp heater 186. Then, the processor 10 generates a drive voltage by suitably selecting half waves from the AC waveform of the AC power supply 1811 according to the application pattern and applies it to the center-distributed halogen lamp heater 186 so as to adjust the temperature to a target temperature (Step S703).

As used herein, the application pattern refers to a pattern that is composed of half waves suitably selected from an AC waveform of a predetermined frequency according to a desired duty cycle. When the duty cycle of the application pattern is less than a predetermined level, e.g. 40%, it is determined that the drive voltage is applied at a low duty cycle, and the applied time of the drive voltage is monitored.

This is because, when the drive voltage at a low duty cycle, which has an application pattern at a low duty cycle of approximately 40%, is applied to the center-distributed halogen lamp heater 186, a chemical attack may occur due to the low effective voltage that is below the standard voltage of the halogen lamp heater.

For example, suppose that the amount of heat required for a fixing process on a thin and "small size" sheet P, which increases the temperature to the target temperature (e.g. from 180° C. to 200° C.), is approximately 360 W. In this case, the duty cycle of the application pattern for the center-distributed halogen lamp heater 186 is 40.0% (=360 W/900 W). As a result, the drive voltage is applied at a low duty cycle.

The processor 10 then makes a determination as to whether the duration of time the drive voltage is applied at a low duty cycle (40.0% or less) exceeds a predetermined period of time (Step S704). In the embodiment, the predetermined period of time is several minutes. When the duration of time the drive voltage is applied exceeds the predetermined period of time, the active heater is switched to the overall-distributed halogen lamp heater 187 in order to prevent degradation of the center-distributed halogen lamp heater 186.

That is, when it is determined that duration of time the drive voltage is applied at a low duty cycle exceeds the predetermined period of time (Step S704, Yes), the processor 10 makes a determination as to whether the temperature in the non-sheet area of the fixing roller 183 is equal to or greater than a predetermined threshold (Step S705).

Then, when it is determined that the temperature is less than the predetermined threshold (Step S705, No), the processor 10 calculates an application pattern for the overall-distributed halogen lamp heater 187 based on the output of the temperature detector 185 (Step S706). Then, the processor 10 generates a drive voltage by suitably selecting half waves from the AC waveform of the AC power supply 1811 according to the application pattern and applies it to the overall-distributed halogen lamp heater 187 so as to adjust the temperature thereof to the target temperature (Step S707). At the same time, the processor turns off the center-distributed halogen lamp heater 186.

Depending on the thickness of the sheet P, e.g. when the sheet P is a board paper, the drive voltage applied to the center-distributed halogen lamp heater 186 may not have a low duty cycle. To cope with such a case, when it is determined that the duration of time the drive voltage is applied at a low duty cycle does not exceed the predetermined period of time yet (Step S704, No), not only the process simply returns to Step S704, but also the processor 10 may further make a determination as to whether the printing (image formation) is completed, and if so, the process may end.

In Step S706, the amount of heat generated by the part of the 320 mm-long filament of the overall-distributed halogen lamp heater 187 that corresponds to the 210 mm-long filament of the center-distributed halogen lamp heater 186 is:

$$(700\ \text{W}/320\ \text{mm})\times 210\ \text{mm}=459.4\ \text{W}.$$

In order to obtain the amount of heat of 360 W required for the fixing process on the sheet P, it is required to set the duty cycle of the application pattern for the overall-distributed halogen lamp heater 187 to:

$$360\ \text{W}/459.4\ \text{W}=78.4\%.$$

Since the drive voltage is not applied at a low duty cycle in this case, no chemical attack occurs.

Since an application pattern is composed of half waves that are suitably selected from an AC waveform of a predetermined frequency according to a duty cycle, it is impossible to form an application pattern that has a duty cycle of exactly 78.4%. Therefore, the processor 10 calculates an application pattern that has a duty cycle close to 78.4% and also satisfies the amount of heat required.

In contrast, when the active heater is switched to the overall-distributed halogen lamp heater 187 in order to prevent degradation of the center-distributed halogen lamp heater 186, the side areas of the fixing roller 183 are also heated, which is however essentially unnecessary. As a result, the temperature is increased in the non-sheet area of the fixing roller 183 where the sheet P does not pass through.

To avoid this, the processor 10 makes a determination as to whether the temperature in the non-sheet area of the fixing roller 183 is increased to a predetermined threshold or more (Step S708). If it is determined that the temperature is increased to the predetermined threshold or more (Step S708, Yes), the processor 10 calculates the application pattern for the center-distributed halogen lamp heater 186 from the output of the temperature detector 185 (Step S709). Then, the processor 10 generates a drive voltage by selecting half waves from the AC waveform of the AC power supply 1811 based on the application pattern and applies it to the center-distributed halogen lamp heater 186 so as to adjust the temperature to the target temperature (Step S710). At the same time, the processor 10 turns off the overall-distributed halogen lamp heater 187.

For example, the processor 10 applies the drive voltage to the center-distributed halogen lamp heater 186 in the same application pattern as in Step S702 and Step S703 (low duty cycle pattern) so as to prevent an increase of the temperature in the non-sheet area.

Depending on the conditions, the temperature in the non-sheet area of the fixing roller 183 is not increased to be equal to or greater than the predetermined threshold. To cope with such a case, if it is determined that the temperature is less than the predetermined threshold (Step S708, No), not only the process simply returns to Step S708, but also the processor 10 may further make a determination as to whether the printing (image formation) is completed, and if so, the process may end.

While the non-sheet area of the fixing roller 183 is cooled to a temperature of less than the predetermined threshold in Step S709 and Step S710, the duration of time the drive voltage is applied to the center-distributed halogen lamp heater 186 at a low duty cycle may sometimes exceed the predetermined period of time. In such cases, when the process simply returns to Step S706 and Step S707, the temperature in the non-sheet area of the fixing roller 183 may be unfavorably further increased.

To avoid this, if the temperature in the non-sheet area of the fixing roller 183 is equal to or greater than the threshold (Step S705, Yes), in other word, if the duration of time the drive voltage is applied to the center-distributed halogen lamp heater 186 at a low duty cycle exceeds the predetermined time and the temperature in the non-sheet area of the fixing roller 183 is not cooled down yet, the processor 10 suspends the printing (image formation), turns off all of the halogen lamp heaters and rotates the fixing roller 183 (Step S711), so as to decrease the temperature in the non-sheet area of the fixing roller 183.

Then, if the temperature in the non-sheet area of the fixing roller 183 is decreased to less than the predetermined threshold (Step S705, No), the process returns to Step S706 and Step S707 so that the printing (image formation) is resumed.

Finally, the processor 10 makes a determination as to whether the printing (image formation) is completed (Step S712). If it is determined that the printing (image formation) is not completed yet (Step S712, No), the process returns to Step S704. If it is determined that the printing (image formation) is completed (Step S712, Yes), the process ends.

In this way, if the duration of time the drive voltage is applied based on an application pattern having a duty cycle of the predetermined level or less exceeds the predetermined time in one of the halogen lamp heaters to which the drive voltage is applied, the processor 10 applies the drive voltage to another one of the halogen lamp heaters with a different distribution based on an application pattern having a duty cycle of greater than the predetermined level. This can prevent an occurrence of chemical attack and thus extend the life of the halogen lamp heaters.

4-2. Description of Operation in Printing on Large Size Sheet

The flowchart of FIG. 8 assumes a case in which the sheet P is of the "large size". The overall-distributed halogen lamp heater 187 has a maximum output of 700 W and a filament length of 320 mm, the center-distributed halogen lamp heater 186 has a maximum output of 900 W and a filament length of 210 mm, and the side-distributed halogen lamp heater 188 has a maximum output of 700 W and a filament length of either side of 50 mm.

The processor 10 makes a determination as to whether the sheet P on which printing (image formation) is to be performed is of the "large size" (Step S801). That is, the processor makes a determination as to whether the width in the direction perpendicular to the conveyance direction of the sheet P is greater than the length of the filament 186*b* of the center-distributed halogen lamp heater 186 and also equal to or less than the length of the filament 187*b* of the overall-distributed halogen lamp heater 187.

If it is determined that the sheet P on which the printing (image formation) is to be performed is of the "large size" (Step S801, Yes), the processor 10 calculates an application pattern for the overall-distributed halogen lamp heater 187 and an application pattern for the center-distributed halogen lamp heater 186 based on the output of the temperature detector 185 (Step S802). Then, the processor 10 generates a drive voltage by suitably selecting half waves from the AC waveform of the AC power supply 1811 according to the application patterns and supplies it to the overall-distributed halogen lamp heater 187 and the center-distributed halogen lamp heater 186, so as to adjust the temperature to the target temperature (Step S803).

In this step, the processor 10 operates the side-distributed halogen lamp heater 188 by an on-off control. In order to avoid flicker due to the on-off control, the processor 10 sets the duty cycle of the overall-distributed halogen lamp heater 187 to 100% so as to operate it at the maximum output.

In Step S803, when the drive voltage is applied to the overall-distributed halogen lamp heater 187 at a duty cycle of 100% (maximum output), the amount of heat generated by the part of the 320-mm filament of the overall-distributed halogen lamp heater 187 that corresponds to the 210-mm filament of the center-distributed halogen lamp heater 186 is:

$$(700\ \text{W}/320\ \text{mm})\times 210=459.4\ \text{W}.$$

For example, suppose that the amount of heat required for a fixing process on the sheet P of the "large size", which increases the temperature to a target temperature (e.g. 180° C. to 200° C.), is approximately 820 W. In this case, the amount of heat required from the center-distributed halogen lamp heater 186 is:

$$820\ \text{W}-459.4\ \text{W}=360\ \text{W}.$$

Then, the duty cycle required to obtain this amount of heat is:

$$360\ \text{W}/900\ \text{W}=40\%.$$

As a result, the drive voltage is applied at the low duty cycle.

To address such a low duty cycle, the processor 10 makes a determination as to whether the duration of time the drive voltage is applied at a low duty cycle (40.0% or less) exceeds the predetermined period of time (Step S804). When the duration of time exceeds the predetermined period of time, the processor 10 turns off the overall-distributed halogen lamp heater 187 and increases the duty cycle of the drive voltage of the center-distributed halogen lamp heater 186, so as to prevent degradation of the center-distributed halogen lamp heater 186.

That is, when it is determined that the duration of time the drive voltage is applied at a low duty cycle exceeds the predetermined period of time (Step S804, Yes), the processor 10 calculates an application pattern for the center-distributed halogen lamp heater 186 based on the output of the temperature detector 185 (Step S805). Then, the processor 10 turns off the overall-distributed halogen lamp heater 187 while it generates a drive voltage by suitably selecting half waves from the AC waveform of the AC power supply 1811 according to the application pattern and applies it to the center-distributed halogen lamp heater 186, so as to adjust the temperature to the target temperature (Step S806). At the same time, the processor 10 operates the side-distributed halogen lamp heater 188 by an on-off control.

For example, the duty cycle of the application pattern for the center-distributed halogen lamp heater 186 is set to 100% (900 W).

However, since the maximum output of the side-distributed halogen lamp heater 188 is 700 W, even when the side-distributed halogen lamp heater 188 is always on, the amount of heat generated does not reach 820 W that is required for a fixing process on the sheet P of the "large size". Accordingly, the temperature in the side areas of the fixing roller 183 is decreased.

To avoid this, the processor 10 makes a determination as to whether the temperature in the side areas of the fixing roller 183 is decreased to the predetermined threshold or less (Step S807). If it is determined that the temperature is decreased to the predetermined threshold or less (Step S807, Yes), the processor 10 calculates respective application patterns for the overall-distributed halogen lamp heater 187 and the center-distributed halogen lamp heater 186 based on the output of the temperature detector 185 (Step S808). Then, the processor 10 generates a drive voltage by suitably selecting half waves from the AC waveform of the AC power supply 1811 according to the application patterns and applies it to the overall-distributed halogen lamp heater 187 and the center-distributed halogen lamp heater 186, so as to adjust the temperature to the target temperature (Step S809).

If it is determined that the temperature is not decreased to the predetermined threshold or less (Step S807, No), the processor 10 makes a determination as to whether the printing (image formation) is completed (Step S810). If it is determined that the printing (image formation) is not completed yet (Step S810, No), the process returns to Step S807. If it is determined that the printing (image formation) is completed (Step S810, Yes), the process ends.

For example, in Step 808, the duty cycle of the application patterns for the overall-distributed halogen lamp heater 187 and the center-distributed halogen lamp heater 186 is both set to 71.4% so that the drive voltage is not applied at a low duty cycle.

In this case, the amount of heat generated by the part of the 320-mm filament of the overall-distributed halogen lamp heater 187 that corresponds to the 100-mm (50 mm×2) filament of the side-distributed halogen lamp heater 188 is:

$$(700\ \text{W}/320\ \text{mm})\times 100\ \text{mm}\times 71.4\%=156.2\ \text{W}.$$

Further, since the side-distributed halogen lamp heater 188 is operated by an on-off control, the output can be represented as 0% or 100% in duty cycle. Accordingly, the amount of heat generated by the side-distributed halogen lamp heater 188 is:

$$700\ \text{W}\times 100\%=700\ \text{W}.$$

As a result, the amount of heat supplied to the fixing roller 183 (the part corresponding to the 100-mm filament of the side-distributed halogen lamp heater 188) is:

$$156.2\ \text{W}\times 700\ \text{W}=856.2\ \text{W}.$$

Since this is greater than the amount of heat required for a fixing process on the sheet P of the "large size", approximately 820 W, the temperature in the side areas of the fixing roller 183 is increased.

To avoid this, the processor 10 makes a determination as to whether the temperature in the side areas of the fixing roller 183 is increased to the predetermined threshold or more (Step S811). If it is determined that the temperature is increased to the predetermined threshold or more (Step S811, Yes), the process returns to Step S802. If it is determined that the temperature is not increased to the predetermined threshold or more (Step S811, No), the processor 10 makes a determination as to whether the printing (image formation) is completed (Step S812). If it is determined that the printing (image formation) is not completed yet (Step S812, No), the process returns to Step S811. If it is determined that the printing (image formation) is completed (Step S812, Yes), the process ends.

In this way, when the duration of time the drive voltage is applied in an application pattern having a duty cycle of the predetermined level or less exceeds the predetermined period of time in one of the halogen lamp heaters to which the drive voltage is applied, the processor 10 applies the drive voltage to one or all of the halogen lamp heaters in an application pattern having a duty cycle of greater than the predetermined level. This can prevent an occurrence of chemical attack and thus extend the life of the halogen lamp heaters.

Variation

In the embodiment (the operation in printing on a small size sheet), when the duration of time the drive voltage is applied in an application pattern having a duty cycle of the predetermined level or less exceeds the predetermined period of time, the drive voltage is applied to another halogen lamp heater with a different distribution in an application pattern having a duty cycle of greater than the predetermined level. Instead, the drive voltage may be applied to all of the halogen lamp heaters in an application pattern having a duty cycle of greater than the predetermined level.

For example, suppose that the sheet P is of the "small size" and a thick sheet that requires a large amount of heat. Further, the overall-distributed halogen lamp heater 187 has a maximum output of 700 W and a filament length of 320 mm, and the center-distributed halogen lamp heater 186 has a maximum output of 900 W and a filament length of 210 mm.

Further, suppose that the amount of heat required for a fixing process on the thick sheet P of the "small size", which raises the temperature to the target temperature (e.g. from 180° C. to 200° C.), is 1084 W. In this case, the amount of heat generated by the center-distributed halogen lamp heater 186 is insufficient, and another 184 W is required to obtain the amount of heat required even when the duty cycle of the application pattern for the center-distributed halogen lamp heater 186 is set to 100% (900 W). Accordingly, it is required to use the overall-distributed halogen lamp heater 187 together.

When the drive voltage is applied to the overall-distributed halogen lamp heater 187 at a duty cycle of 100% (maximum output), the amount of heat generated in the part of the 320-mm filament of the overall-distributed halogen lamp heater 187 that corresponds to the 210-mm filament of the center-distributed halogen lamp heater 186 is:

$$(700\ \text{W}/320\ \text{mm})\times 210 = 459.4\ \text{W}.$$

The amount of heat required from the overall-distributed halogen lamp heater 187 is 184 W, and the duty cycle to generate this amount of heat is:

$$184\ \text{W}/459.4\ \text{W} = 40\%.$$

As a result, the drive voltage is applied at the low duty cycle.

To cope with such a case, the processor 10 may be configured such that if the duration of time the drive voltage is applied at a low duty cycle (40.0%) exceeds the predetermined period of time, it applies the drive voltage to both of the overall-distributed halogen lamp heater 187 and the center-distributed halogen lamp heater 186 in an application pattern having a duty cycle of greater than a predetermined level (40%).

Specifically, the drive voltage is applied to the overall-distributed halogen lamp heater 187 in an application pattern having a duty cycle of 100%, and the drive voltage is applied to the center-distributed halogen lamp heater 186 in an application pattern having a duty cycle of 71.4%. In this case, the total amount of heat supplied to the part corresponding to the 210-mm filament of the center-distributed halogen lamp heater 186 is 1102 W.

Alternatively, the drive voltage is applied to the overall-distributed halogen lamp heater 187 in an application pattern having a duty cycle of 80%, and the drive voltage is applied to the center-distributed halogen lamp heater 186 in an application pattern having a duty cycle of 80%. In this case, the total amount of heat supplied to the part corresponding to the 210-mm filament of the center-distributed halogen lamp heater 186 is 1087.5 W.

In this way, the drive voltage is applied to the overall-distributed halogen lamp heater 187 and the center-distributed halogen lamp heater 186 in an application pattern having a duty cycle of greater than the predetermined level. This can prevent an occurrence of chemical attack and extend the life of the halogen lamp heaters.

When the overall-distributed halogen lamp heater 187 is used together and the drive voltage is applied in an application pattern having a duty cycle of greater than the predetermined level (40%), the temperature in the non-sheet area of the fixing roller 183 may be increased to the predetermined threshold or more.

In this case, like Step S711 in FIG. 7, the temperature in the non-sheet area of the fixing roller 183 may be decreased by suspending the printing (image formation), turning off the halogen lamp heaters and rotating the fixing roller 183. Alternatively, the temperature in the non-sheet area of the fixing roller 183 may be decreased by decreasing the duty cycle of the overall-distributed halogen lamp heater 187 (e.g. to 40%).

As described above, when the duration of time the drive voltage is applied in an application pattern having a duty cycle of the predetermined level or less exceeds the predetermined period of time in one of the two halogen lamp heaters to which the drive voltage is applied, the processor 10 applies the drive voltage to the two halogen lamp heater in an application pattern having a duty cycle of greater than the predetermined level. This can prevent an occurrence of chemical attack and thus extend the life of the halogen lamp heater.

In the embodiment (the operation in printing on a large size sheet), when the temperature in the side areas is equal to or less than the threshold, the duty cycle of the application pattern is increased so that the temperature in the side areas is increased. When this is not enough to sufficiently increase temperature in the side areas, the overall-distributed halogen lamp heater 187 may be operated at the maximum output while the drive voltage is applied to the center-distributed halogen lamp heater 186 in an application pattern having a duty cycle of the predetermined level or less.

That is, the overall-distributed halogen lamp heater 187 is operated at the maximum output so that the temperature in the side areas is increased rapidly. Accordingly, although the drive voltage is temporally applied to the center-distributed halogen lamp heater 186 in an application pattern having a duty cycle of the predetermined level or less, the duration of time thereof can be reduced. This can prevent an occurrence of chemical attack and thus extend the life of the halogen lamp heaters.

In the embodiment, the image fixing device 18 includes the fixing roller 183 and the pressing roller 184, which constitute a nip portion that nips and conveys the sheet P. However, the image fixing device 18 may further include a heating roller as a heating member and a fixing belt, in which the fixing belt is supported and stretched between the heating roller and the fixing roller 183, and the fixing roller 183 and the pressing roller 184 together with the fixing belt intervened therebetween constitute the nip portion that nips and convey the sheet P.

The embodiment illustrates an example in which the image forming apparatus 1 includes image forming units respectively for the colors of Y (yellow), M (magenta), C (cyan) and K (black), and an color image is formed on the sheet P. However, this configuration is merely an example, and the image forming apparatus may be configured to form a monochromatic image.

In the embodiment, the fixing roller and the pressing roller are distinguished from each other. However, they can be considered as a pair of fixing members.

The embodiment illustrates an example in which a sheet is used as a recording medium. However, the recording medium is not limited to paper, and may be constituted by any sheet material on which a toner image can be formed and fixed. For example, such materials include non-woven, plastic film, leather and the like.

This U.S. patent application claims priority to Japanese patent application No. 2015-241736 filed on Dec. 11, 2015, the entire contents of which are incorporated by reference herein for correction of incorrect translation.

What is claimed is:

1. An image forming apparatus, comprising:

halogen lamp heaters with different distributions which heat a fixing member of an image fixing device;

an AC power supply;

a temperature detector which detects a temperature of the fixing member; and a processor which calculates an application pattern for the halogen lamp heaters based on an output of the temperature detector and which generates a drive voltage by suitably selecting half waves from an AC waveform of the AC power supply according to the application pattern and applies the drive voltage to the halogen lamp heaters, wherein when a duration of time the drive voltage is applied to a first halogen lamp heater in the application pattern having a duty cycle of a predetermined level or less exceeds a predetermined period of time, (i) the processor turns off the first halogen lamp heater and turns on a second halogen lamp heater with a different distribution, or (ii) the processor increases the duty cycle of the first halogen lamp heater to greater than the predetermined level and decreases a duty cycle of the second halogen lamp heater.

2. The image forming apparatus according to claim 1, wherein when a duration of time the drive voltage is applied to the first halogen lamp heater in the application pattern having a duty cycle of a predetermined level or less exceeds a predetermined period of time, the processor applies the drive voltage to the first and second halogen lamp heaters in the application pattern having a duty cycle of greater than the predetermined level.

3. The image forming apparatus according to claim 1, wherein the halogen lamp heaters comprises an overall-distributed halogen lamp heater which heats an entire area of the fixing member and a center-distributed halogen lamp heater which heats a center area of the fixing member, and wherein when a width of a recording medium is less than a width of the center-distributed halogen lamp heater, the processor applies the drive voltage to the center-distributed halogen lamp heater in a first application pattern having a duty cycle of a predetermined level or less, and (i) when the duration of time exceeds a predetermined period of time, the processor applies the drive voltage to the overall-distributed halogen lamp heater in a second application pattern having a duty cycle of greater than the predetermined level, and (ii) when a temperature in a non-sheet area of the fixing member is increased to a predetermined threshold or more, the processor applies the drive voltage to the center-distributed halogen lamp heater in the first application pattern.

4. The image forming apparatus according to claim 3, wherein when the temperature in the non-sheet area is equal to or greater than the threshold and the duration of time the drive voltage is applied in the first application pattern exceeds a predetermined period of time in the center-distributed halogen lamp heater, the processor suspends image formation and rotates the fixing member.

5. The image forming apparatus according to claim 1, wherein the halogen lamp heaters comprise an overall-distributed halogen lamp heater which heats an entire area of the fixing member, a center-distributed halogen lamp heater which heats a center area of the fixing member and a side-distributed halogen lamp heater which heats side areas of the fixing member, and wherein when a width of a recording medium is greater than a width of the center-distributed halogen lamp heater but is equal to or less than a width of the overall-distributed halogen lamp heater, the processor operates the side-distributed halogen lamp heater by an on-off control, operates the overall-distributed halogen lamp heater at a maximum output and applies the drive voltage to the center-distributed halogen lamp heater in a first application pattern having a duty cycle of a predetermined level or less, and (i) when a duration of time the drive voltage is applied exceeds a predetermined period of time in the center-distributed halogen lamp heater, the processor turns off the overall-distributed halogen lamp heater and applies the drive voltage to the center-distributed halogen lamp heater in a second application pattern having a duty cycle of greater than the predetermined level, and (ii) when a temperature in the side areas of the fixing member decreases to a predetermined threshold or less, the processor applies the drive voltage to the overall-distributed halogen lamp heater and the center-distributed halogen lamp heater in a third application pattern having a duty cycle of greater than the predetermined level.

6. The image forming apparatus according to claim 5, wherein when the temperature in the side areas is equal to or less than the threshold and the temperature in the side areas is not increased, the processor operates the overall-distributed halogen lamp heater at the maximum output and applies the drive voltage to the center-distributed halogen lamp heater in the first application pattern.

* * * * *